US006062924A

United States Patent [19]

Nakamura

[11] Patent Number: 6,062,924

[45] Date of Patent: May 16, 2000

[54] TILT LOCK DEVICE FOR OUTBOARD MOTOR

[75] Inventor: Tamotsu Nakamura, Saitama, Japan

[73] Assignee: Showa Corporation, Saitama, Japan

[21] Appl. No.: 09/135,684

[22] Filed: Aug. 18, 1998

[30] Foreign Application Priority Data

Feb. 23, 1998 [JP] Japan ..... 10-040558

[51] Int. Cl.[7] ..... B63H 20/08

[52] U.S. Cl. ..... 440/61; 440/55

[58] Field of Search ..... 440/61, 55, 56

[56] References Cited

U.S. PATENT DOCUMENTS

| | | | |
|---|---|---|---|
| 4,944,705 | 7/1990 | Kashima et al. | 440/61 |
| 5,519,995 | 5/1996 | Sasse et al. | 60/476 |
| 5,876,259 | 3/1999 | Nakamura | 440/61 |

FOREIGN PATENT DOCUMENTS 258155 12/1998 Japan .

*Primary Examiner*—Jesus D. Sotelo
*Attorney, Agent, or Firm*—Dvorak & Orum

[57] ABSTRACT

A tilt lock device 10 comprises a cylinder 12, a piston 13 vertically slidably inserted into the cylinder 12, a piston rod 14 connected to an upper portion of the piston 3, upper and lower oil chambers S1 and S2 respectively formed in upper and lower portions of the piston 13, an accumulator chamber S3 mounted to the cylinder 12 in a manner to surround the cylinder 12 and being in communication with the upper and lower oil chambers S1 and S2 through upper and lower oil passages 45 and 12*a*. A first relief valve 18 is provided in the upper oil passage 45 and is opened when a pressure in the upper oil chamber S1 in which the piston 13 rises exceeds a predetermined value.

8 Claims, 10 Drawing Sheets

TILT LOCK DEVICE FOR OUTBOARD MOTOR

BACKGROUND OF THE INVENTION

1. Field of the Invention

The present invention relates to a tilt lock device for an outboard boat motor.

2. Description of the Related Art

The prior art shows a tilt lock device for an outboard motor in Japanese Patent Application Publication No. 2-58155 (TILT LOCK DEVICE FOR OUTBOARD MOTOR).

This prior art reduces a tilt-up operation force by a simple structure in addition to a basic function of the tilt lock device. As shown in FIGS. 1, 4, and 5 of this publication, this device comprises a cylinder 8, a piston 12 movably inserted in the cylinder 8, a piston rod 11 mounted to the piston 12, first and second oil chambers 8*a* and 8*b* defined in opposite sides of the piston 12, passages 13 and 14 provided in the piston 12 for interconnecting these first and second chambers 8*a* and 8*b*, check valves 15 (first relief valves) and 16 provided in intermediate portions of the passages 13 and 14, a communication passage 24 for interconnecting these first and second chambers 8*a* and 8*b* outside the cylinder 8 so as to bypass the piston 12, a switch valve 37 provided in an intermediate portion of the communication passage 24, a second relief valve provided in the switch valve 37, and comprising a valve seat 42, a valve body 44 and a spring 47.

The first and second relief valves are for buffering the shock that an outboard motor B receives when the outboard motor B collides against an obstacle such as driftwood or a log.

In the above-described prior art, however, since the check valve 16 is connected to the piston 12, the first relief valve 15 also connected to the piston 12 experiences a restriction in size because a space for mounting the first relief valve 15 is small and therefore, there is the disadvantage of difficulty to sufficiently exhibit a buffering performance of the tilt lock device.

Further, since the second relief valve having the same function as that of the first relief valve 15 is provided as a separate member from the first relief valve 15, the tile lock device occupies a large space. Furthermore, the communication passage 24 is extended outwardly from the cylinder 8, and the switch valve 37 is provided in the intermediate portion of the communication passage 24, there is a disadvantage in that a pipe laying operation at the time of assembling is troublesome.

SUMMARY OF THE INVENTION

It is an object of the present invention to provide a compact tilt lock apparatus for an outboard motor in which a buffering performance can be enhanced and the manufacturing cost of which can be reduced.

To achieve the above object, according to the present invention, there is provided a tilt lock apparatus for an outboard motor in which the outboard motor is mounted to a boat stern, wherein the outboard motor can be stopped at an arbitrary position when the outboard motor is swung from its in-use position to its stand-by position, a tilt lock apparatus is interposed between the stern and the outboard motor in order to moderate a shock applied to the outboard motor during running, wherein the tilt lock apparatus comprises a cylinder, a vertically movable piston in the cylinder, a piston rod connected to an upper portion of the piston, upper and lower oil chambers respectively formed in upper and lower portions of the piston, an accumulator chamber mounted to the cylinder such as to surround the cylinder and being in communication with the upper and lower oil chambers through upper and lower oil passages, and a first relief valve provided in the upper oil passage which opens when a pressure in the upper oil chamber in which the piston rises exceeds a predetermined value.

BRIEF DESCRIPTION OF THE DRAWINGS

The present invention will be understood more fully from the detailed description given hereinbelow and from the accompanying drawings of the preferred embodiments of the invention, which are given by way of example only, and are not intended to limit the present invention.

In the drawings.

DESCRIPTION OF THE PREFERRED EMBODIMENTS

An embodiment of the present invention will be explained with reference to the accompanying drawings. The drawings should be seen in the direction of reference numbers and symbols.

Figure 1:
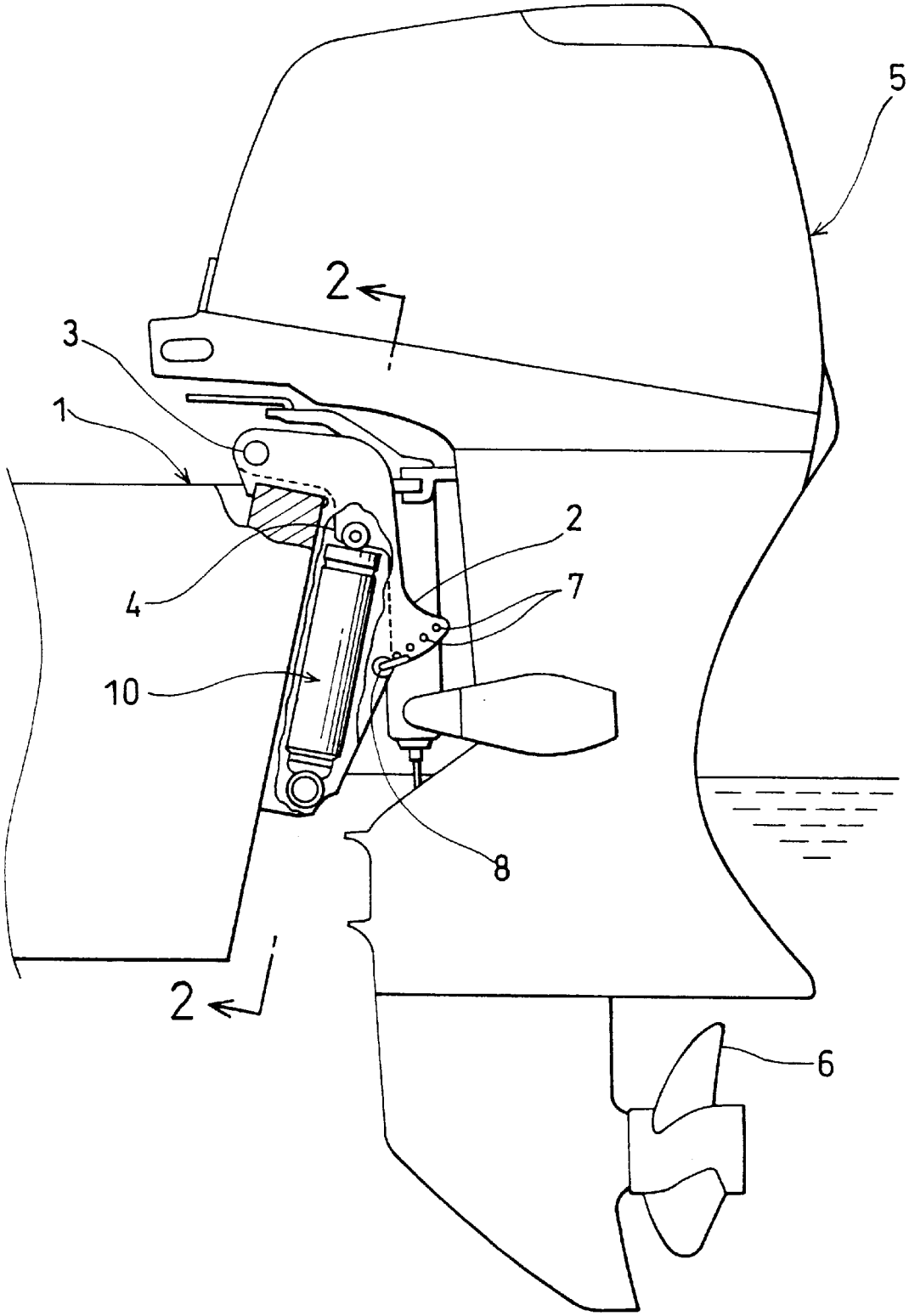
FIG. 1 is a side view showing a state where a tilt lock device of the present invention is mounted between a boat stern and an outboard motor.

FIG. 1 is a side view showing a state where a tilt lock device of the present invention is mounted between a stern and an outboard motor. FIG. 1 shows a state where a stern 1 is fixed to a stern bracket 2, a swivel bracket 4 is mounted to the stern bracket 2 so that the swivel bracket 4 can vertically rotate around a horizontal shaft 3, an outboard motor 5 is mounted to the swivel bracket 4, and a tilt lock device 10 is provided between the stern bracket 2 and the swivel bracket 4. The reference number 6 denotes a propeller of the outboard motor 5, the reference numbers 7 . . . (". . . " means the plural, the same is true hereinafter) denote position adjusting holes opened at rear portions of the stern bracket 2. The reference number 8 denotes a stopper pin used for adjusting a tilt-down position of the outboard motor 10 by selectively inserting the stopper pin into one of the position adjusting holes 7 . . . .

Figure 2:
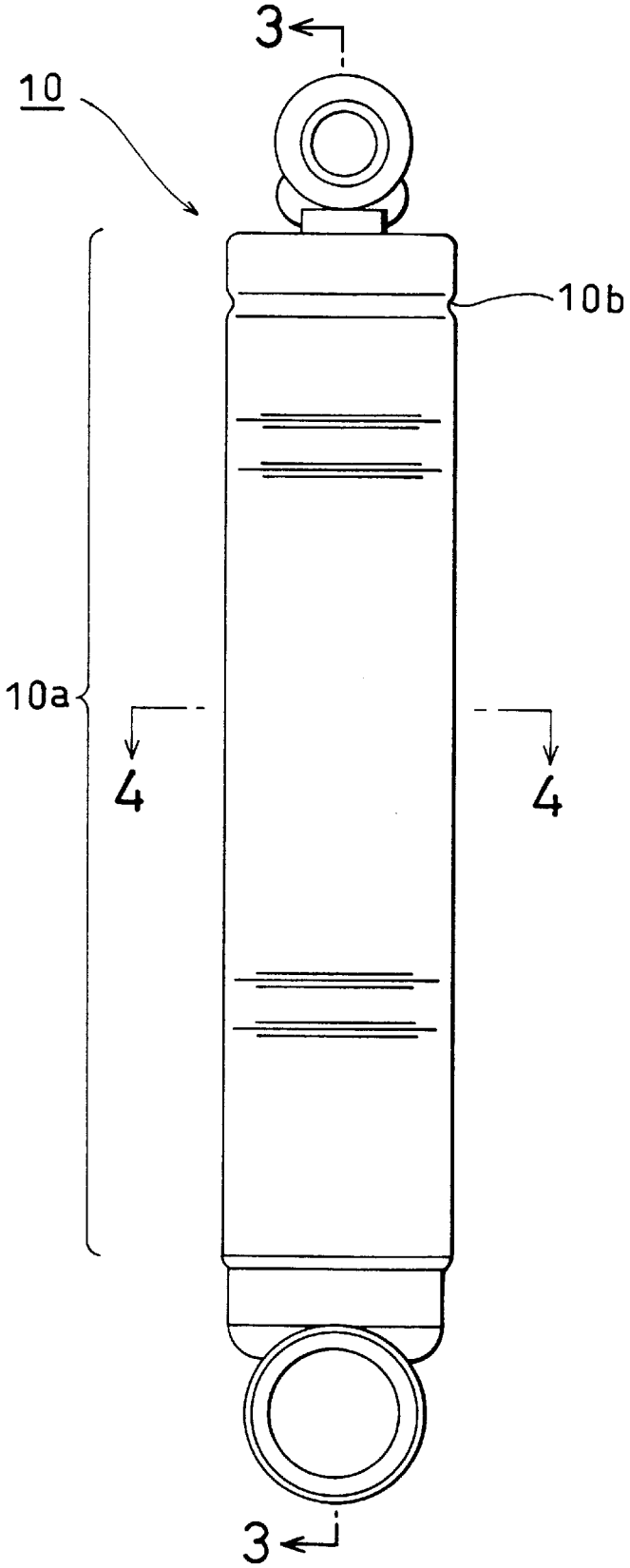
FIG. 2 is a side view showing the tilt lock device of the present invention.

FIG. 2 is a side view of a tilt lock device according to the present invention, and shows that the width of the body 10*a* of the tilt lock device 10 is constant in the longitudinal direction of the boat body except for a constricted portion 10*b*.

Figure 3:
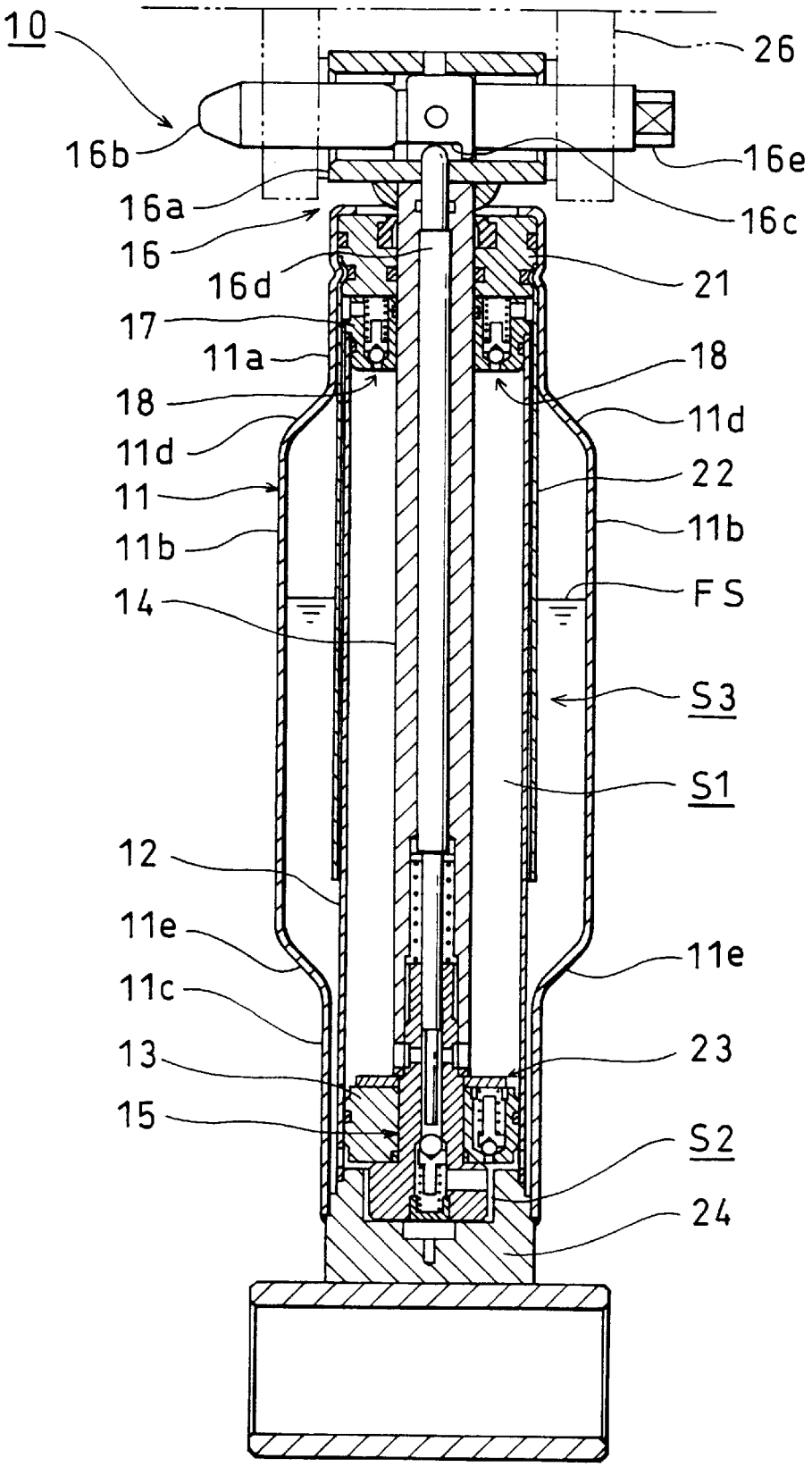
FIG. 3 is a sectional view taken along the line 3—3 in FIG. 2.

FIG. 3 is a sectional view taken along the line 3—3 in FIG. 2, and shows a state in which the tilt lock device 10 contracts to the utmost.

The tilt lock device 10 comprises an outer cylinder 11 whose longitudinal central portion expands outward, an inner cylinder 12 disposed inside of the outer cylinder 11, a piston 13 vertically movable into the inner cylinder 12, a hollow piston rod 14 extended from an upper portion of the piston 13, a manual on-off valve 15 also serving as a mounting member for the hollow piston rod 14 to the piston 13, a manual operating mechanism 16 for opening and closing the manual on-off valve 15, an upper block 17 connected to an upper portion of the inner cylinder 12, and first relief valves 18 in the upper block 17.

The tilt lock device 10 further comprises a rod guide 21 mounted to an upper portion of the outer cylinder 11 for guiding the hollow piston rod 14 which moves vertically, an intermediate cylinder 22 disposed outside the inner cylinder 12 with a predetermined clearance and secured so that an upper portion of the intermediate cylinder 22 is sandwiched between the rod guide 21 and the outer cylinder 11, a second relief valve 23 provided in the piston 13, and a lower block 24 attached to lower portions of the outer and inner cylinders 11 and 12. The reference number 26 denotes an upper mounting member for rotatably mounting an upper portion of the manual operating mechanism 16 to the swivel bracket 4 (see FIG. 1).

The tilt lock device 10 further comprises upper and lower oil chambers S1 and S2 defined in the inner cylinder 12 by the piston 13, and an accumulator S3 as an accumulator chamber also serving as a volume compensating chamber provided between the outer and inner cylinders 11 and 12.

The outer cylinder 11 comprises an upper cylindrical portion 11*a*, wide portions 11*b* and 11*b* swelling outward, a lower cylindrical portion 11*c*, upper slope portions 11*d* and 11*d* formed between the upper cylindrical portion 11*a* and the wide portions 11*b* and 11*b*, and lower slope portions 11*e* and 11*e* formed between the wide portions 11*b*, 11*b* and the lower cylindrical portion 11*c*.

The manual operating mechanism 16 comprises a base 16*a* mounted to the upper end of the hollow piston rod 14, a camshaft 16*b* rotatably mounted to the base 16*a*, a cam portion 16*c* formed on the camshaft 16*b*, and an operating rod 16*d* which moves vertically in the hollow piston rod 14 such as to follow a peripheral surface of the cam portion 16*c*. The reference number 16*e* denotes a hexagonal end portion for mounting a handle which is not shown.

The lower block 24 also serves as a mounting member for rotatably mounting the lower end of the tilt lock device 10 to a stern bracket 2 (see FIG. 1).

The accumulator S3 has an upper portion in which a gas having a pressure higher than atmospheric pressure is charged, and has a lower portion filled with hydraulic fluid, and is in communication with the lower oil chamber S2 through oil holes 12*a* and 12*a* (see FIG. 5) as lower oil passages are opened at the lower end of the inner cylinder 12. The reference symbol FS denotes an oil surface.

When the hollow piston rod 14 enters into the inner cylinder 12 by the accumulator S3, hydraulic fluid in an amount corresponding to that volume of the hollow piston rod 14 enters into the inner cylinder 12 and moves into the accumulator S3 from the upper and lower oil chambers S1 and S2 through the oil holes 12*a* (see FIG. 5) so that oil surface FS rises. When the hollow piston rod 14 is retracted from the inner cylinder 12, hydraulic fluid in an amount corresponding to that volume of the hollow piston rod 14 which retracts from the inner cylinder 12 moves from the accumulator S3 into the upper and lower oil chambers S1 and S2 through the oil holes 12*a* and 12*a* (see FIG. 5) so that the oil surface FS is lowered, thereby compensating for the variation in volume of the hydraulic fluid.

Figure 4:
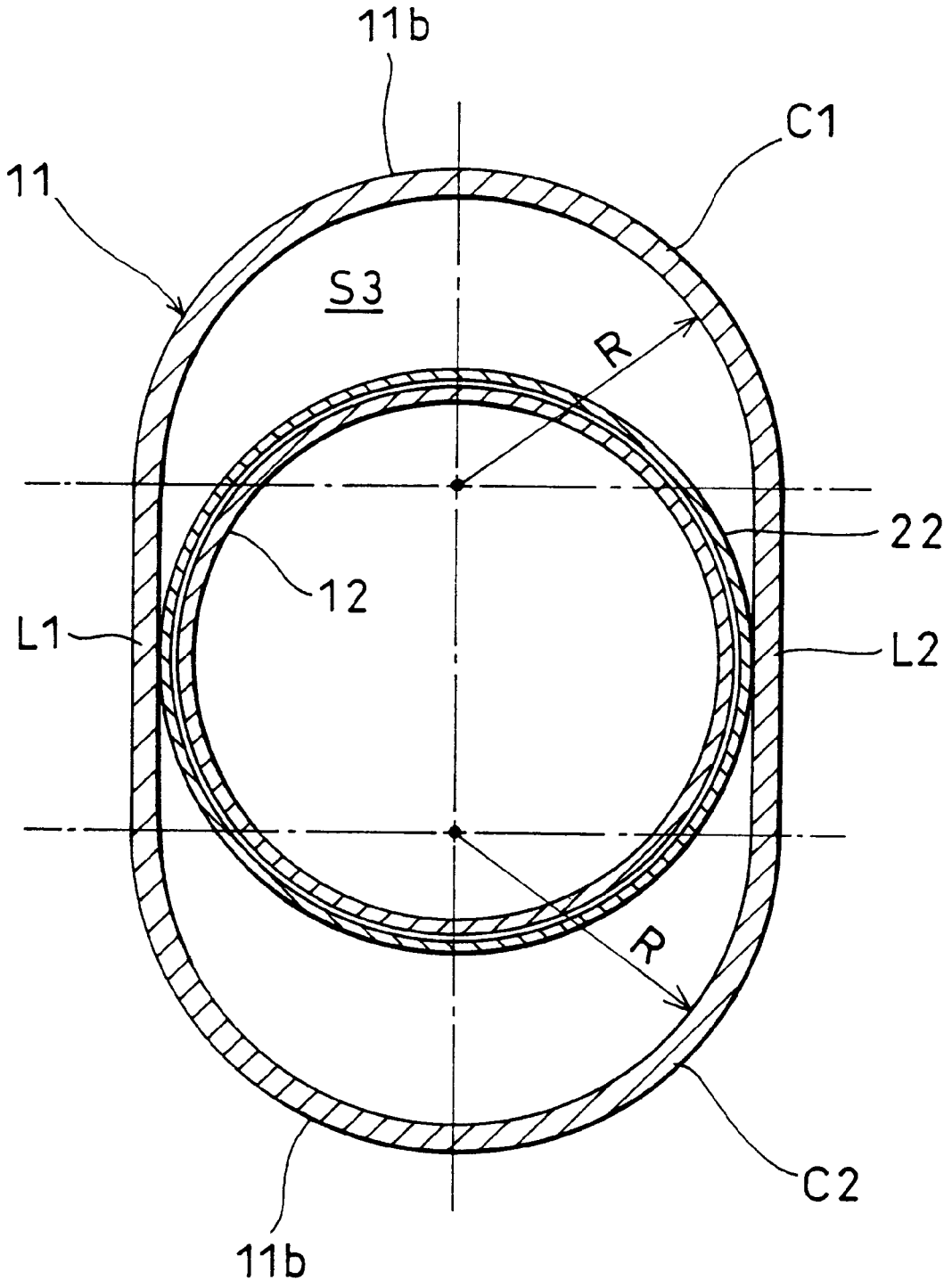
FIG. 4 is a sectional view taken along the line 4—4 in FIG. 2.

FIG. 4 is a sectional view taken along the line 4—4 in FIG. 2, and shows that a cross-section of the outer cylinder 11 passing the wide portions 11*b* and 11*b* of the center portion thereof is formed into a flat cylindrical shape, so that the cross-section is formed into an elliptical shape having a semicircular ends C1 having a radius R, a straight side L1, a semicircular C2 having the radius R and a straight side L2, and that the accumulator S3 is produced between the outer and inner cylinder 11 and 12.

As described above, in the tilt lock device 10 (see FIG. 3), the inner cylinder 12 is surrounded by the outer cylinder 11 to form the accumulator S3, and since the central portion of the outer cylinder 11 is formed into a cylindrical shape having the flat cross-section, the tilt lock device 10 (see FIG. 3) is mounted so that the flat direction thereof lies in a longitudinal direction of the outboard motor 5 (see FIG. 1). Therefore, longitudinal space occupied by the tilt lock device 10 (see FIG. 3) becomes smaller, the operability of the outboard motor 5 (see FIG. 1) at the time of steering and tilting operation can be enhanced, and both the brackets 2 and 4 (see FIG. 1) can be reduced in size.

Figure 5:
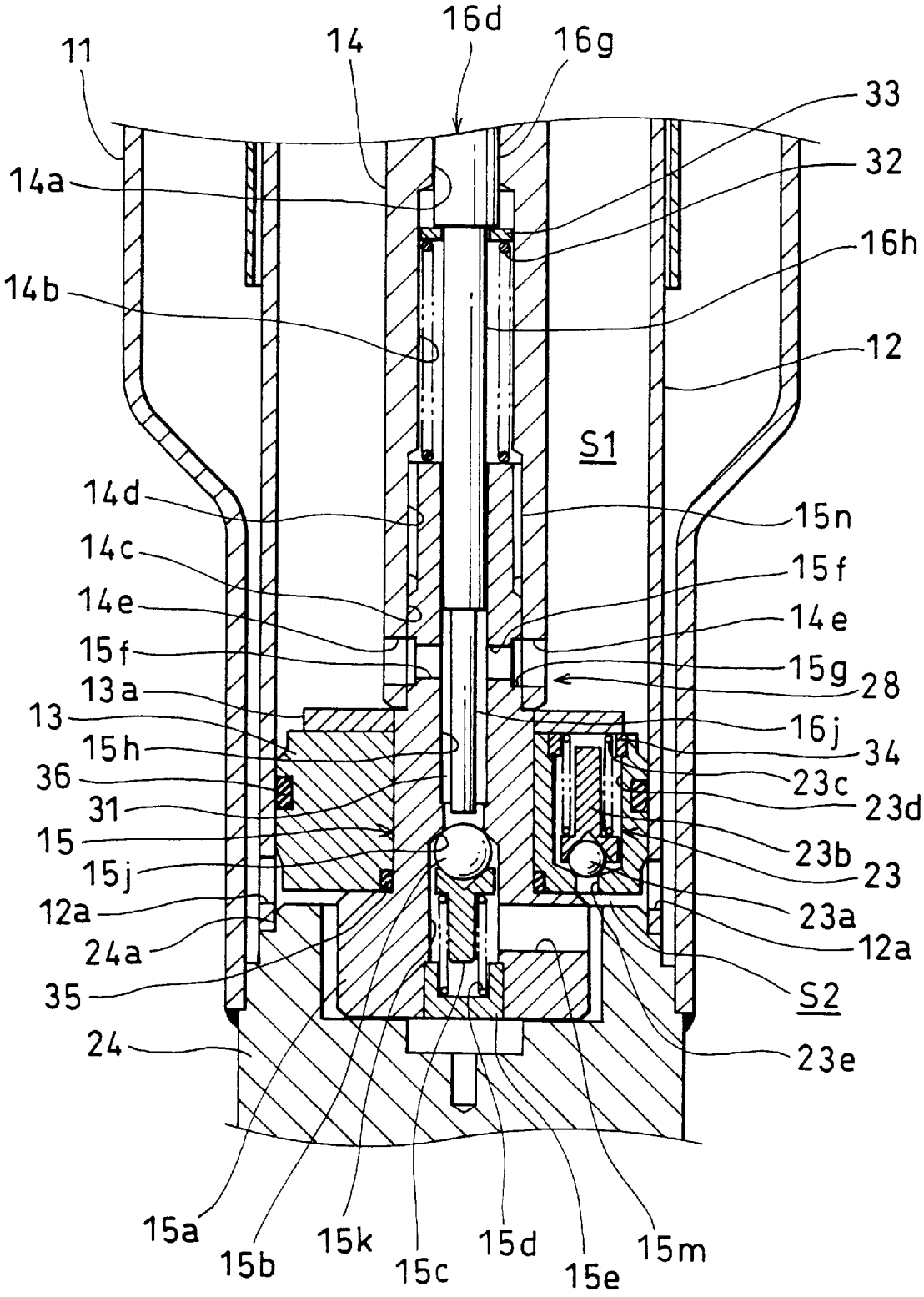
FIG. 5 is an enlarged sectional view of a lower portion of the tilt lock device of the invention.

FIG. 5 is an enlarged sectional view of a lower portion of the tilt lock device according to the present invention, and the outer cylinder 11 is welded to the lower block 24.

A lower end of the inner cylinder 12 is tightly or loosely inserted into a small-diameter portion 24*a* of the lower block 24.

The piston 13 includes plate 13*a* between the piston 13 itself and the hollow piston rod 14 for holding an upper end of the second relief valve 23.

The hollow piston rod 14 is provided at its lower portion with a small-diameter vertical hole 14*a* for guiding vertical movement of the operating rod 16*d* of the manual operating mechanism 16 (see FIG. 3), an intermediate-diameter vertical hole 14*b* is opened at the lower small-diameter vertical hole 14*a*, a large-diameter vertical hole 14*c* is opened at the lower intermediate-diameter vertical hole 14*b*, a female screw 14*d* formed in an upper portion of the large-diameter vertical hole 14*c*, and first oil passages 14*e* and 14*e* passing through the large-diameter vertical hole 14*c* to the upper oil chamber S1.

The piston 13 and the hollow piston rod 14 includes a communication passage 28 for interconnecting the upper and lower oil chambers S1 and S2. The communication passage 28 is provided at its intermediate portion with a manual on-off valve 15.

The manual on-off valve 15 comprises a valve case 15*a* also serving as a valve seat connected to the hollow piston rod 14 through a screw, a valve body 15*b* provided in the valve case 15*a*, a spring 15*d* for pressing, at its upper end, the valve body 15*b* through a retainer 15*c*, and a lower lid 15*e* for supporting a lower end of the spring 15*d* and for closing a lower portion of the valve case 15*a*.

The valve case 15*a* is provided with first lateral oil passages 15*f* opened at the upper side surface of the valve body 15*b*, an annular oil passage 15*g* communicating with the first lateral oil passages 15*g* and the first oil passages 14*e* of the hollow piston rod 14, a vertical upwardly opening oil passage 15*h* on the valve body 15*b*, a valve chamber 15*k* accommodating a valve seat 15*j*, the valve body 15*b*, the retainer 15*c* and the spring 15*d*, and a second lateral oil passage 15*m* for interconnecting the valve chamber 15*k* and the lower oil chamber S2. A male screw 15*n* is formed on an upper portion of the valve case 15*a* for threaded engagement with the female screw 14*d* of the hollow piston rod 14.

The operating rod 16*d* of the manual operating mechanism 16 (see FIG. 3) comprises a large-diameter portion 16*g*, an intermediate-diameter portion 16*h* and a lower small-diameter portion 16*j*.

The lower small-diameter portion 16*j* has an outer diameter smaller than an inner diameter of the vertical oil passage 15*h* of the manual on-off valve 15, and a lower end of the lower small-diameter portion 16*h* depresses the valve body 15*b* of the manual on-off valve 15. An oil passage 31 is defined between an inner peripheral surface of the vertical oil passage 15*h* and an outer peripheral surface of the lower small-diameter portion 16*j*. A spring 32 and a retainer 33, are interposed between a lower end of the large-diameter portion 16*g* and an upper end of the valve case 15*a* of the manual on-off valve 15 so that an upper end of the operating rod 16*d* abuts against the cam portion 16*c* of the camshaft 16*b* shown in FIG. 3.

In FIG. 5, in the second relief valve 23, the piston 13 also functions as a valve case and a valve seat. The second relief valve 23 comprises a valve body 23*a*, a spring 23*c* for pressing the valve body 23*a* in its closing direction, i.e., downward through the retainer 23*b*, a valve chamber 23*d* accommodating the valve body 23*a*, the retainer 23*b* and the spring 23*c*, and an oil passage 23*e* communicated with an oil passage (not shown) and the lower oil chamber S2 leading to the upper oil chamber S1 from the valve chamber 23*d*. The reference number 34 denotes a ring for positioning an upper end portion of the spring 23*c*, and the reference numbers 35 and 36 denote O-rings.

The communication passage 28 comprises the first oil passages 14*e* of the hollow piston rod 14, an inner peripheral of the hollow piston rod 14 and an inner periphery of the piston 13.

Figure 6:
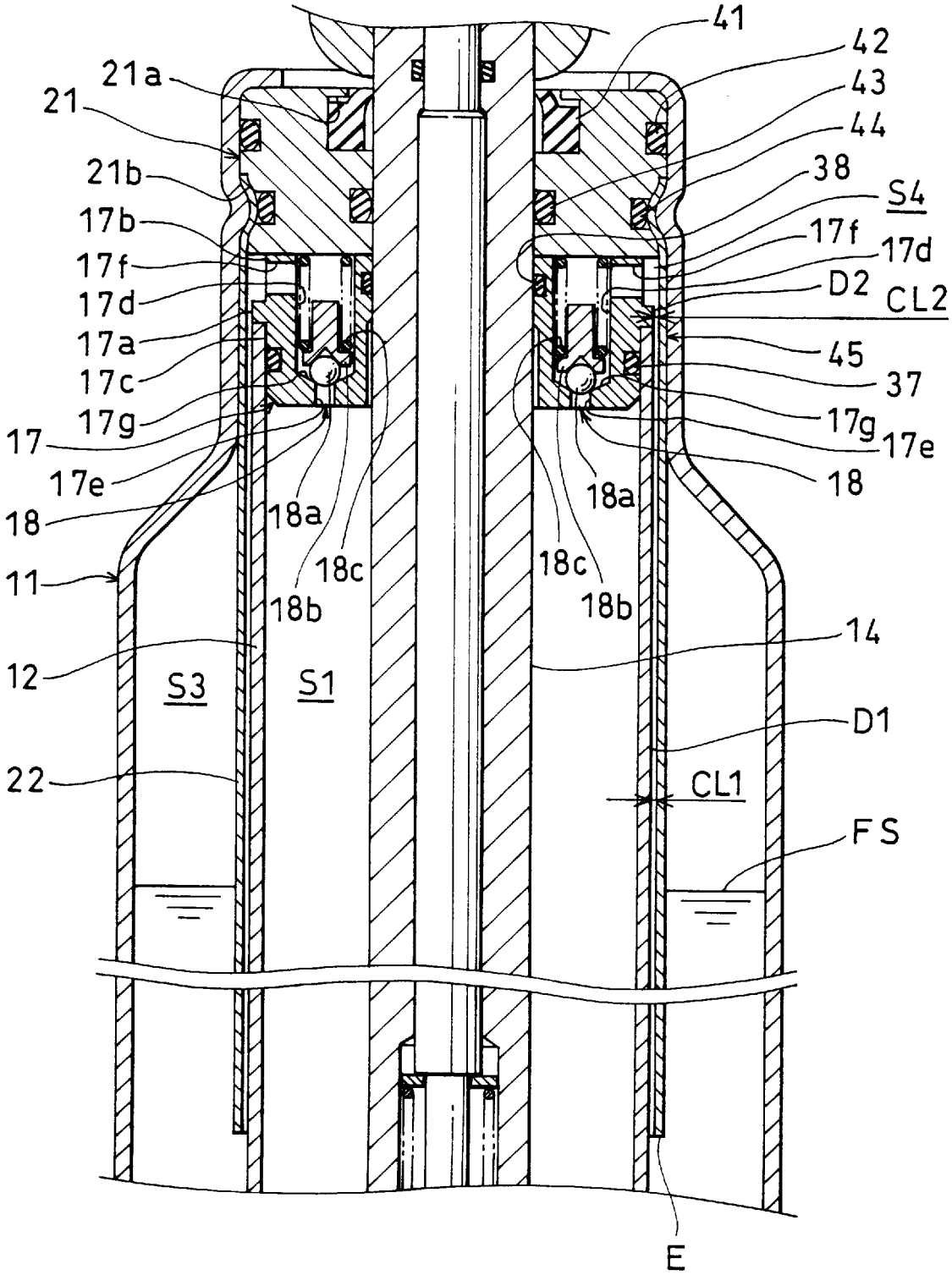
FIG. 6 is an enlarged sectional view of an upper portion of the tilt lock device of the invention.

FIG. 6 is an enlarged sectional view of an upper portion of the tilt lock device according to the present invention. The upper block 17 comprises an outer peripheral portion 17*a*, an upper small-diameter portion 17*b* provided in an upper portion, a lower small-diameter portion 17*c* into which the inner cylinder 12 is inserted through an O-ring 37, recesses 17*d* comprising valve chambers of the first relief valves 18, oil passages 17*e* leading to the upper oil chamber S1 from the recesses 17*d*, and oil passages 17*f* leading to the outside oil chamber S4 of the upper small-diameter portion 17*b*. The reference numbers 17*g* denote bottoms of the recesses 17*d* serving as valve seats of the first relief valves 18, and the reference number 38 denotes an O-rings for sealing the clearance between the hollow piston rod 14 and the upper block 17.

The first relief valve 18 opens when pressure in the upper oil chamber S1 exceeds a predetermined value, and includes, in the recesses 17*d* of the upper block 17, valve bodies 18*a*, and springs 18*c* pressing the valve bodies 18*a* through retainers 18*b*.

The rod guide 21 includes a recess 21*a* formed in an upper portion of the rod guide 21 for mounting a dust seal 41, and a constricted portion 21*b*. The rod guide 21 is fixed to the outer cylinder 11 by the constricted portion 21*b* and the upper end of the outer cylinder 11 is crimped and mounted. The reference numbers 42, 43 and 44 denote O-rings.

The intermediate cylinder 22 includes a clearance D1 having a clearance size CL1 between the intermediate cylinder 22 and the inner cylinder 12, and a clearance D2 having a clearance size CL2 between the intermediate cylinder 22 and the rod guide 21. An upper end of the intermediate cylinder 22 is inserted between the outer cylinder 11 and the rod guide 21. The intermediate cylinder 22 is fixed and secured to the outer cylinder 11 by the constricted portion 21*b* of the rod guide 21, so that a lower end E is always bathed in the hydraulic fluid even if the oil surface FS is vertically moved.

The oil passages 17*e*, the recesses 17*d*, the oil passages 17*f*, the oil chamber S4, the clearance D2 and the clearance D1 constitute an upper oil passage 45.

As described above, the tilt lock device 10 (see FIG. 3) comprises the inner cylinder 12, the piston 13 (see FIG. 5) vertically and slidably inserted into the inner cylinder 12, the piston rod 14 attached to the upper portion of the piston 13, the upper and lower oil chambers S1 and S2 (see FIG. 5) formed in the upper and lower portion of the piston 13, respectively, the accumulator S3 communicated with the upper and lower oil chambers S1 and S2 through the upper and lower oil passages 45 and 12*a* (see FIG. 5) and fixed to the inner cylinder 12 so as to surround the inner cylinder 12, and the first relief valves 18 which open when the piston 13 rises and a pressure in the upper oil chamber S1 exceeds the predetermined value. Therefore, as space for mounting the first relief valves 18 is increased, flexibility in design such as a relief pressure of, mounting space and the number of each of the first relief valves 18 is enhanced and thus, it is possible to enhance the buffering performance of the tilt lock device 10.

The tilt lock device 10 (see FIG. 3) is compact as compared with a structure where the first relief valves 18 are provided outside of the inner cylinder 12. A flexibility for mounting the tilt lock device 10 between the boat stern and the outboard motor 5 is enhanced, and a flexibility in design of the shape of each of the stern bracket 2 and the swivel bracket 4 mounted to the opposite ends of the tilt lock device 10 as well as the outboard motor 5 is enhanced.

Further, transport and handling at the time of maintenance before the tilt lock device 10 is mounted to the outboard motor are facilitated.

Furthermore, an external communication passage outside of the inner cylinder 12 (see FIG. 3) is unnecessary, and it is unnecessary to cast-mold a pipe integrally with a side of the cylinder, so the assembling of the tilt lock device 10 (see FIG. 3) is facilitated, and the cost can be lowered.

From the above-described reasons, it is possible to lower the cost to produce an outboard motor 5 including a tilt lock device 10 and mounting brackets 2 and 4.

The manual operation of the above described tilt lock device 10 will be explained next.

Figure 7B:
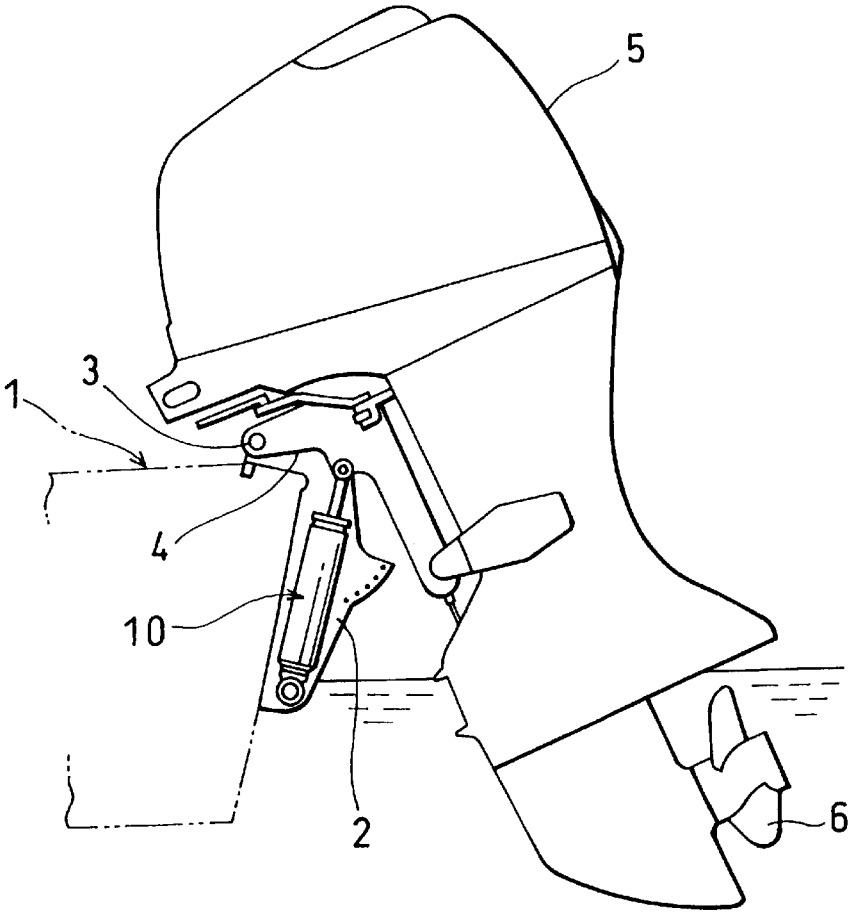
FIGS. 7A and 7B are views for explaining a manual operation of the tilt lock device of the invention.
Figure 7A:
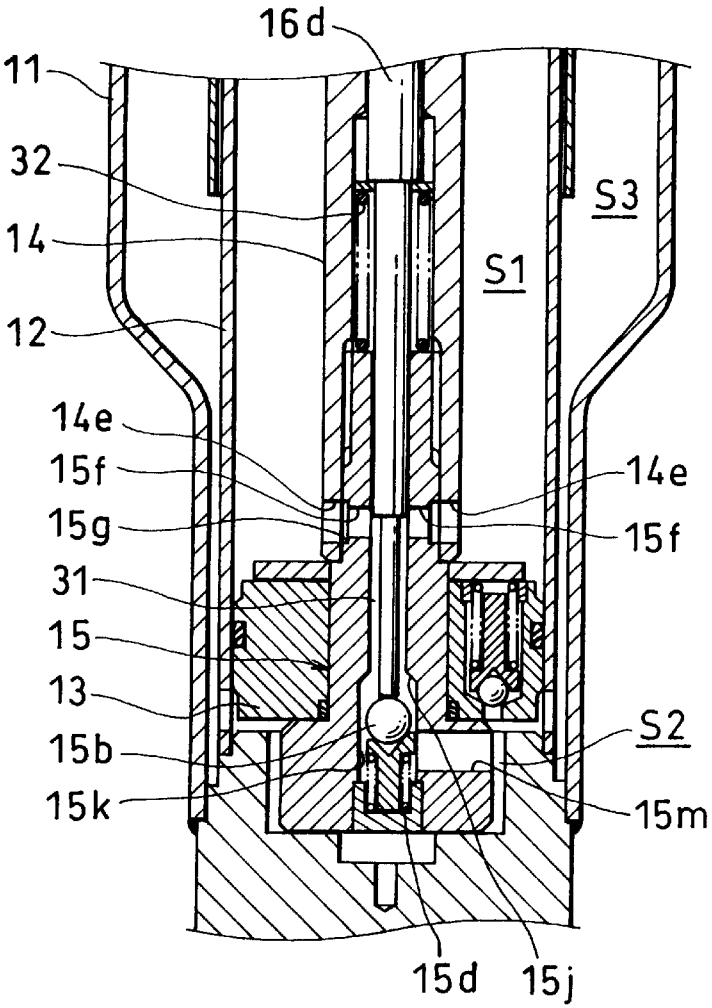

FIGS. 7A and 7B are views explaining the manual operation of the tilt lock device of the invention. FIG. 7A shows a state where the manual on-off valve 15 is opened, and FIG. 7B shows a tilt state of the outboard motor.

For example, when the boat advances ashore, it is necessary to tilt up the outboard motor 5 so that the lower end of the outboard motor 5 does not hit the bottom of the sea or river as shown in FIG. 7B.

In such a case, in FIG. 3, a handle is put on the hexangular end 16*e* of the camshaft 16*b* of the manual operation device 16, and is rotated.

With this operation, the operation rod 16*d* is lowered by the cam portion 16*c* of the camshaft 16*b*.

In FIG. 7A, by lowering the operation rod 16*d*, the valve body 15*b* of the manual on-off valve 15 is pushed down by the lower end of the operation rod 16*d*. With this operation, the manual on-off valve 15 is opened, the upper oil chamber S1 is brought into communication with the lower oil chamber S2 through the first oil passages 14*e* of the hollow piston rod 14, the annular oil passage 15*g*, the first lateral oil passages 15*f* of the manual on-off valve 15, the oil passage 31, the valve chamber 15*k* and the second lateral oil passage 15*m*, so that the hollow piston rod 14 and the piston 13 can move vertically.

In FIG. 7B, the outboard motor 5 is inclined upward to a desired angle by the manual operation while keeping the state shown in FIG. 7A as it is.

At that time, since a tension force is applied to the tilt lock device 10, the piston 13 shown in FIG. 7A rises, and a pressure in the upper oil chamber S1 is increased. Therefore, the hydraulic fluid in the upper oil chamber S1 flows into the lower oil chamber S2 through the first oil passages 14*e* of the hollow piston rod 14, the annular oil passage 15*g*, the first lateral oil passages 15*f* of the manual on-off valve 15, the oil passage 31, the valve chamber 15*k* and the second lateral oil passage 15*m*.

At that time, since the gas pressure in the accumulator S3 assists the extension of the tilt lock device 10 (see FIG. 7B), the above described tilting up operation can be carried out easily.

After that, the camshaft 16*b* of the manual operation mechanism 16 shown in FIG. 3 is again rotated to raise the operation rod 16*d* by the force of the spring 32 shown in FIG. 7A.

With these operations, the lower end of the operation rod 16*d* is separated from the valve body 15*b*, the valve body 15*b* sits on the valve seat 15*j* by a resilient force of the spring 15*d*, and the manual on-off valve 15 is closed and returns to the condition shown in FIG. 5.

Therefore, hydraulic fluid can not flow between the upper and lower oil chambers S1 and S2, the piston 13 can not move vertically, and the tilt lock state is established.

With such an operation also, the boat can advance ashore through shallow water. When landing the boat, the outboard motor 5 is inclined substantially horizontally by the manual operation of the tilt lock device 10 shown in FIG. 7B, and such a state can be maintained.

To return the outboard motor 5 into a substantially vertical state as shown in FIG. 1, the manual on-off valve 15 may be opened by the above described manual operation.

With this measure, if the boat body is being stopped, the outboard motor 5 is slowly returned to the substantially vertical state by the weight of the outboard motor 5 itself. If the boat body is running ashore, the outboard motor 5 is returned to the substantially vertical state by the weight of the outboard motor 5 itself and the driving force. At that time, the hydraulic fluid in the inner cylinder 12 flows through the passages opposite from the case in which the outboard motor 5 is tilted up.

The automatic operation of the above described tilt lock device 10 will be explained next.

Figure 8:
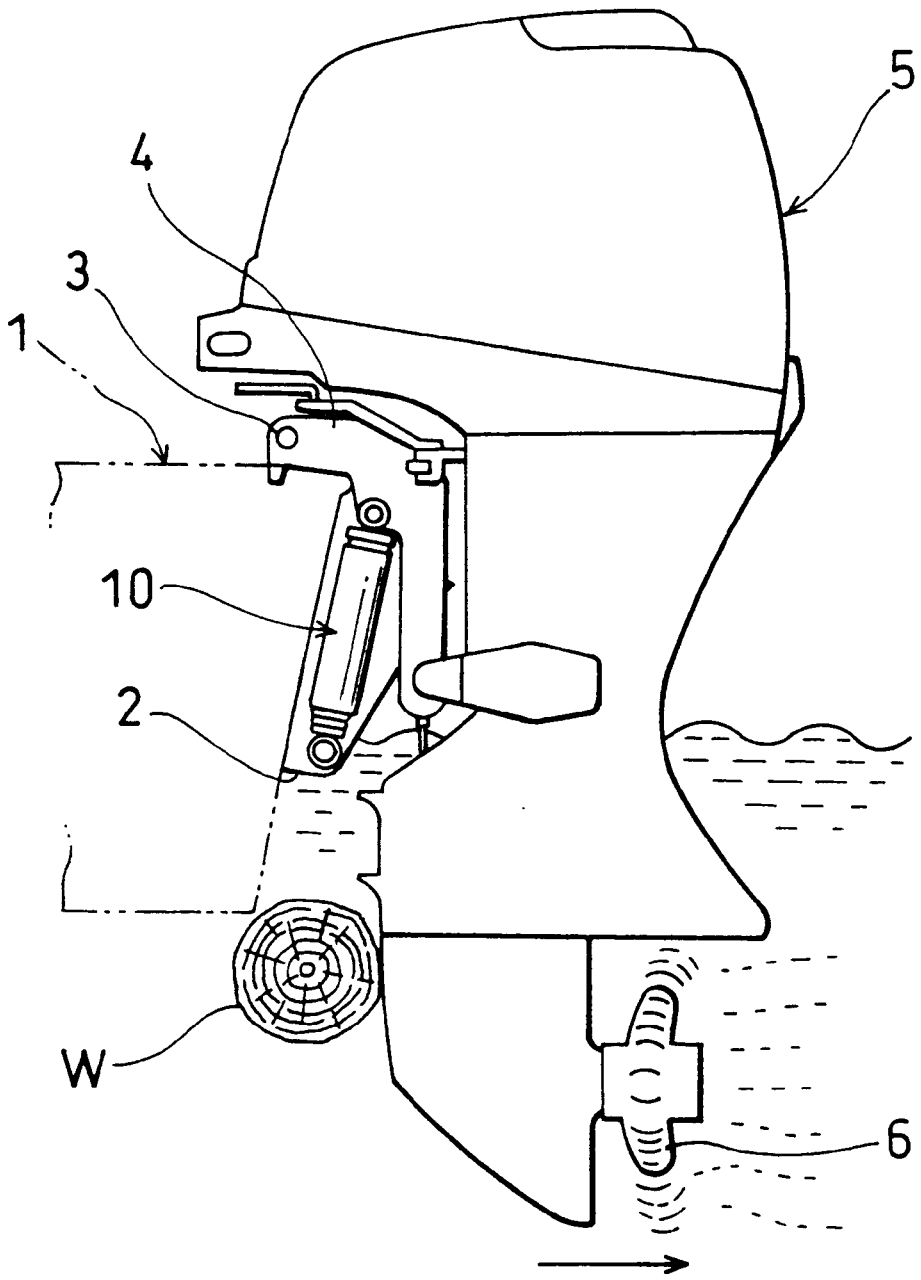
FIG. 8 is a view (the first half) for explaining an automatic operation of the tilt lock device of the invention.

FIG. 8 is a view (the first half) for explaining the automatic operation of the tilt lock device of the invention, and also shows a state where an external impact force is applied to the outboard motor.

Figure 9:
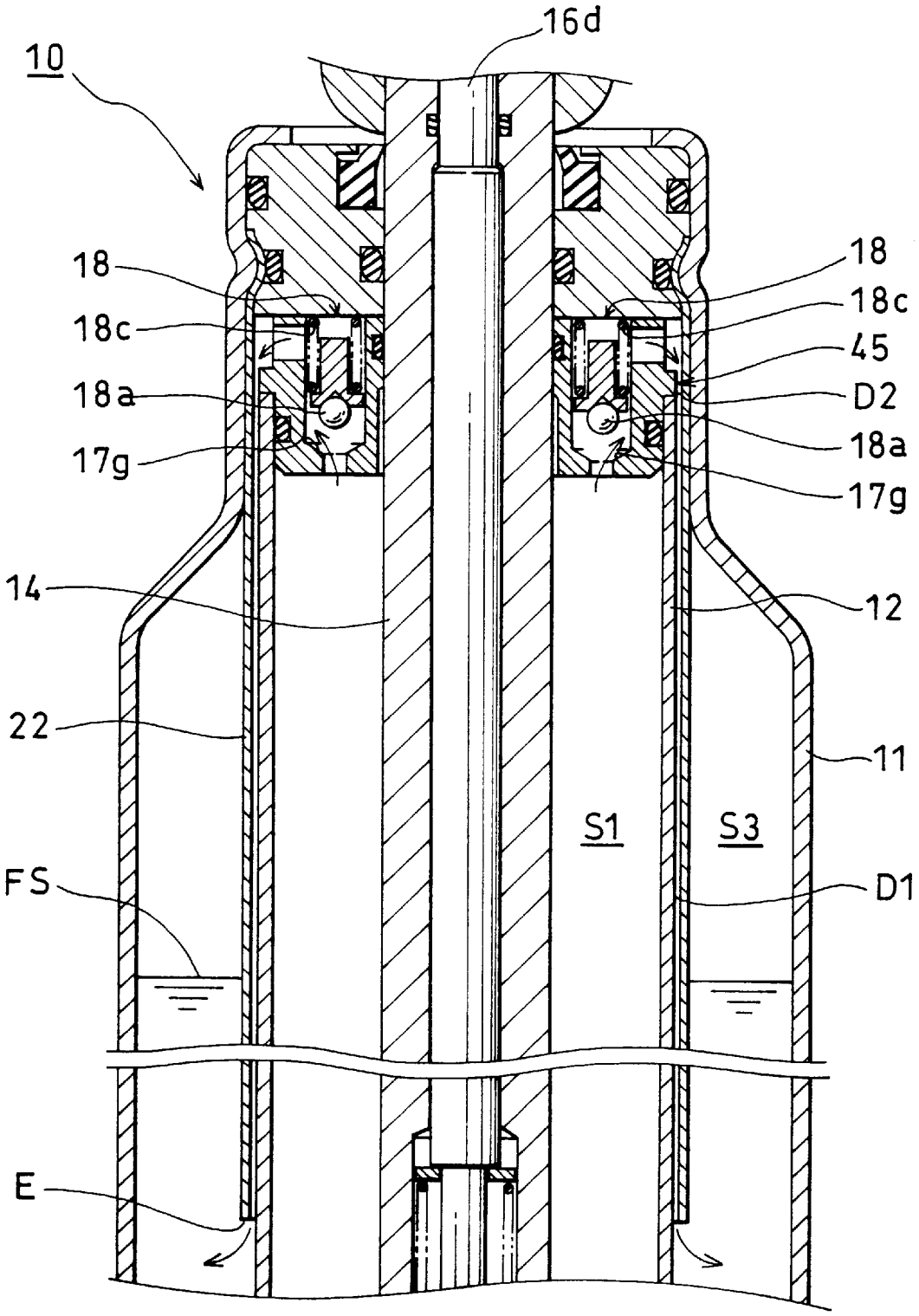
FIG. 9 is a view (the second half) for explaining the automatic operation of the tilt lock device of the invention.

FIG. 9 is a view (the second half) for explaining the automatic operation of the tilt lock device of the invention, and also shows a state in which the first relief valve is opened.

In FIG. 8, when driftwood or a log W collides against a front portion of the outboard motor 5 during travel, a rearward force is applied to the lower portion of the outboard motor 5 as shown by the arrow, and a tension force is applied to the tilt lock device 20.

In FIG. 3, by tension force applied to the tilt lock device 10, the piston 13 (see FIG. 5) tends to rise, and the pressure in the upper oil chamber S1 is increased.

In FIG. 6, if the pressure in the upper oil chamber S1 exceeds a predetermined value, i.e., the value=(a pressure in the accumulator S3)+(a set load of the spring 18*c* of the first relief valve 18)/(a cross section of contact portions of the valve body 18*a* and the bottom 17*g* of the recess 17*d*), the first relief valves 18 and 18 are opened as shown in FIG. 9.

In FIG. 9, if the first relief valve 18 is opened, the piston 13 (see FIG. 5) and the hollow piston rod 14 start rising, and the hydraulic fluid in the upper oil chamber S1 flows into the accumulator S3 through the upper oil chamber 45 as shown by the arrows, and the tilt lock device 10 shown in FIG. 8 is stretched so that the outboard motor 5 is tilted.

Therefore, it is possible to buffer a shock applied to the outboard motor 5, and to prevent the outboard motor 5 from being damaged by the tilt lock device 10.

As shown in FIG. 6, the intermediate cylinder 22 is inserted into the accumulator S3 while keeping the predetermined clearance D1 from the inner cylinder 12, the accumulator S3 is filled with hydraulic fluid and gas so that the lower end E of the intermediate cylinder 22 is always bathed in the hydraulic fluid, and the oil passages 17*e*, the recesses 17*d*, the oil passages 17*f*, of the upper block 17, the oil chamber S4, the clearance D2 and the clearance D1 shown in FIG. 6 constitute the upper oil passage 45. Therefore, when the first relief valves 18 are opened, gas in the accumulator S3 does not flow back to the upper oil chamber S1 through the upper oil passage 45 and thus, gas should not be accumulated in the upper oil chamber S1 and a tilt lock performance of the tilt lock device 10 shown in FIG. 8 can be maintained.

When an external force is not applied to the outboard motor 5, the piston 13 shown in FIG. 5 does not rise, the pressure in the upper oil chamber S1 is reduced to or lower than the predetermined value, and the first relief valves 18 are closed as shown in FIG. 6.

In FIG. 8, when the boat normally runs after the outboard motor 5 is tilted, the outboard motor 5 may be manually returned to the vertical state shown in the drawing.

As described-above, since the first relief valves 18 are provided in the upper oil passage 45 of the upper portion of the inner cylinder 12, if the piston 13 (see FIG. 5) is forcibly moved upward, the first relief valves 18 are opened and air mixed in the upper oil chamber S1 can be released to the accumulator S3 just after the tilt lock device is assembled. Further, the accumulator S3 is mounted to the inner cylinder 12 so as to surround the inner cylinder 12, and this will permit the upper oil passage 45 to be shorter.

Therefore, air can easily be vented for these reasons.

The operation of the above-described second relief valve 23 will be explained next.

Figure 10:
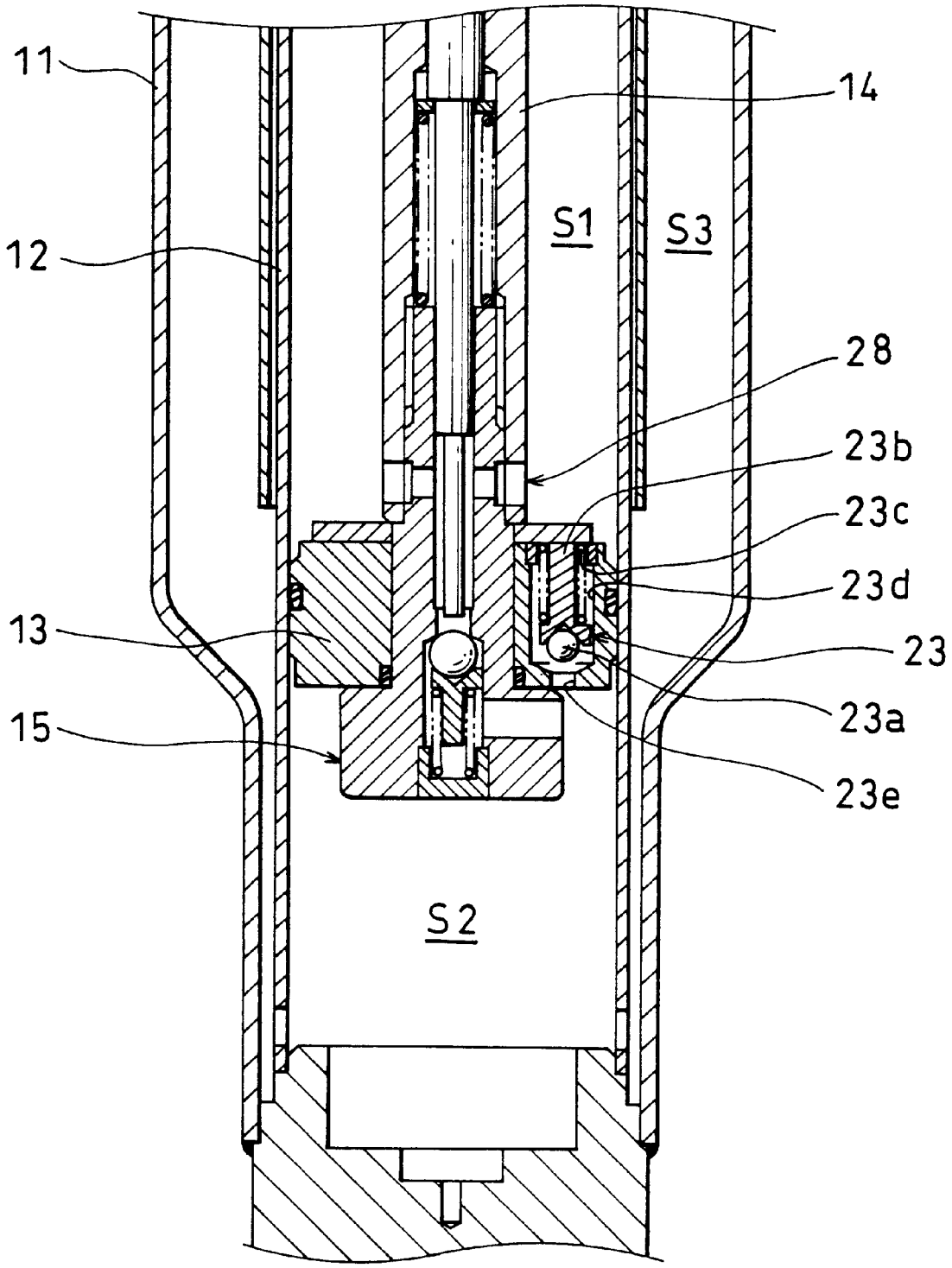
FIG. 10 is a sectional view showing a function of a second relief valve of the invention.

FIG. 10 is a sectional view showing the operation of the second relief valve of the present invention.

As shown in FIG. 7B, there is a circumstance where after the boat runs ashore with the outboard motor 5 being tilted, the boat then advances back into the water with the outboard motor 5 being turned substantially vertically and starts normal running as shown in FIG. 1.

At that time, the output of the outboard motor 5 is increased thus increasing the drive force. With this, in FIG. 7B, a forward force of the boat body is applied to the low portion of the outboard motor 5 by the increased driving force of the outboard motor 5.

For this reason, a compression force is applied to the tilt lock device 10.

In FIG. 10, the pressure in the lower oil chamber S2 is increased by the compression force of the tilt lock device 10 (see FIG. 7B), and when a difference in pressure between this pressure and a pressure in the upper oil chamber S1 exceeds the predetermined value, the second relief valve 23 is opened. The hydraulic fluid in the lower oil chamber S2 flows into the upper oil chamber S1 through the oil passage 23*e* and the valve chamber 23*d* of the second relief valve 23 and an oil passage (not shown). Thereby, the piston 13 is lowered, and the tilt lock device 10 shown in FIG. 7B is withdrawn, and, the outboard motor 5 returns to a substantially original state automatically as shown in FIG. 1.

If the pressure in the lower oil chamber S2 shown in FIG. 10 is reduced to or lower than the predetermined value, the second relief valve 23 is closed so that the outboard motor 5 is tilt-locked and therefore, the boat can run normally.

As described above, the piston is provided with the communication passage 28 for interconnecting the upper and lower oil chambers S1 and S2, the communication passage 28 is provided with the second relief valve 23 which is opened when the pressure in the lower oil chamber S2 exceeds the predetermined value, and in a running ashore state where the piston 13 rises to an intermediate portion of the inner cylinder 12, when the pressure in the lower oil chamber S2 exceeds the predetermined value, the second relief valve 23 is opened and the piston 13 is automatically lowered so that the running ashore state is cancelled. Therefore, when the boat is running ashore, the forward driving force of the boat body of the outboard motor 5 is increased and a large compression force is applied to the tilt lock device 10 shown in FIG. 7B, the piston 13 (see FIG. 10) is lowered so that the outboard motor 5 is turned to a substantially vertical direction, and the running state can automatically be shifted to the normal running state.

Therefore, in this case, a manual operation is eliminated and thus, the operability of the outboard motor is enhanced.

The tilt lock device of the outboard motor of the present invention should not be limited to outboard motors, and it can be employed in other hoisting and lowering devices also.

Although two identical first relief valves 18 (see FIG. 6) are provided in the present embodiment, the present invention should not be limited to this design only, and any one of a spring constant of each of the springs 18*c* and the number of springs 18*c* may be changed (if the number of the springs is changed, the number should be one, or three or more) and further, both the spring constant and the number may be changed.

If the spring constants of the springs are changed or differed, a shock to be applied to the outboard motor 5 (see FIG. 8) by the tilt lock device 10 can be absorbed stepwisely, and the buffering function can be further enhanced.

The present invention exhibits the following effects by the above-described structure:

As described above, the tilt lock device of the present invention comprises the cylinder, the piston vertically slidably inserted into this cylinder, the piston rod attached to the upper portion of this piston, the upper and lower oil chambers formed in the upper and lower portion of the piston, respectively, the accumulator chamber communicated with the upper and lower oil chambers through the upper and lower oil passages and mounted to the cylinder such as to surround the cylinder, and the first relief valves which open when the piston rises and a pressure in the upper oil chamber exceeds a predetermined value. Therefore, a space for mounting the first relief valve is increased, a flexibility in design such as a relief pressure of, mounting space and the number of each of the first relief valves is enhanced and thus, it is possible to enhance the buffering performance of the tilt lock device.

The tilt lock device is compact as compared to the case where the first relief valves are provided outside the inner cylinder. A flexibility for mounting the tilt lock device between the boat stern and the outboard motor is enhanced, and a flexibility in design of the shape of each of the stern bracket and the swivel bracket mounted to the opposite ends of the tilt lock device is enhanced.

Further, transport and handling at the time of maintenance before the tilt lock device is mounted to the outboard motor are facilitated.

Furthermore, an external communication passage connected outside from the cylinder is unnecessary, and it is unnecessary to cast-mold a passage or pipe integrally with a side of the cylinder, and the assembling of the tilt lock device is facilitated, and production cost is lowered.

For the above-described reasons, it is possible to hold down the cost of the outboard motor including a tilt lock device and a mounting brackets.

Futhermore, in the tilt lock device of the present invention, the cylinder is surrounded by the outer cylinder to form the accumulator, and since the central portion of the outer cylinder is formed into a cylindrical shape having the flat cross-section, the tile lock device can be mounted so that the flat direction thereof is directed into the longitudinal direction of the outboard motor. Therefore, the longitudinal space occupied by the tilt lock device becomes smaller, a projecting amount of the tilt lock device rearward of the boat body of the outboard motor becomes smaller, and the operability of the outboard motor at the time of steering and tilting operation can be enhanced.

Furthermore, in the tilt lock device of the present invention, the piston is provided with a passage for interconnecting the upper and lower oil chambers. The communication passage is provided with the second relief valve which is opened when the pressure in the lower oil chamber exceeds the predetermined value, and in a running ashore state where the piston rises to an intermediate portion of the cylinder. When the pressure in the lower oil chamber exceeds the predetermined value, the second relief valve is opened and the piston is automatically lowered so that the running ashore state can be cancelled. Therefore, when the boat is running ashore, the forward driving force of the boat body of the outboard motor is increased and a large compression force is applied to the tilt lock device. The piston is lowered so that the outboard motor is turned to a substantially vertical direction, and the running state can automatically be shifted to the normal running state. Therefore, in this case, a manual operation is eliminated and thus, the operability of the outboard motor can be enhanced.

Furthermore, in the tilt lock device of the present invention, the cylindrical member is inserted into the accumulator chamber while maintaining a predetermined clearance from the cylinder, the accumulator is filled with hydraulic fluid and gas so that the lower end of the cylindrical member always bathes in the hydraulic fluid, and the above clearance constitute the upper oil passage. Therefore, when the first relief valves are opened, gas in the accumulator does not flow back to the upper oil chamber through the upper oil passage and thus, the gas should not be accumulated in the upper oil chamber and a tilt lock performance of the tilt lock device can be maintained.

While the preferred embodiments of the invention have been described in detail with reference to the drawings, they are by no means limitative, and various changes and modifications are possible without departing from the scope and spirit of the invention.

Although the invention has been illustrated and described with respect to several exemplary embodiments thereof, it should be understood by those skilled in the art that the foregoing and various other changes, omissions and additions may be made to the present invention without departing from the spirit and scope thereof. Therefore, the present invention should not be understood as limited to the specific embodiment set out above but to include all possible embodiments which can be embodied within a scope encompassed and equivalents thereof with respect to the feature set out in the appended claims.

What is claimed is:

1. A tilt lock device for an outboard motor in which said outboard motor is mounted to a stern of a boat and can be stopped at an arbitrary position when it is swung from its in-use position to its stand-by position, the tilt lock apparatus being interposed between said stern and said outboard motor in order to moderate a shock applied to said outboard motor during running, wherein said tilt lock apparatus comprises a cylinder, a piston vertically slidably disposed in said cylinder, a piston rod connected to an upper portion of said piston, upper and lower oil chambers respectively formed in upper and lower portions of said piston, an accumulator chamber surrounding said cylinder and being in communication with said upper and lower oil chambers through upper and lower oil passages, and one or more first relief valves provided in said upper oil passage and being opened when a pressure in said upper oil chamber in which said piston rises exceeds a predetermined value.

2. A tilt lock device for an outboard motor according to claim 1, wherein said accumulator chamber is formed by surrounding said cylinder with an outer cylinder, and a central portion of said outer cylinder is a cylinder having a flat cross-section.

3. A tilt lock device for an outboard motor according to claim 1, wherein said piston is provided with a communication passage for interconnecting said upper and lower oil chambers, said communication passage being provided with a second relief valve which is opened when pressure in said lower oil chamber exceeds a predetermined value, and in a running-ashore state where said piston rises to an intermediate position, if the pressure in said lower oil chamber exceeds the predetermined value, said second relief valve is opened, and said piston is automatically lowered.

4. A tilt lock device for an outboard motor according to claim 1, wherein a cylindrical member is inserted into said accumulator chamber while keeping a predetermined clearance from said cylinder, said accumulator chamber being filled with hydraulic fluid and gas so that a lower end of said cylindrical member always bathes in the hydraulic fluid, and said clearance constitutes said upper oil passage, so that when said first relief valve is opened, gas in said accumulator chamber does not flow back to said upper oil chamber through said upper oil passage.

5. A tilt lock device for an outboard motor according to claim 1, wherein each of said first relief valves comprises a valve body and a spring for pressing said valve body, the spring constants of each of said first relief valves being different from one another.

6. A tilt lock device for an outboard motor according to claim 2, wherein each of said first relief valves comprises a valve body and a spring for pressing said valve body, the spring constants of each of said first relief valves being different from one another.

7. A tilt lock device for an outboard motor according to claim 3, wherein each of said first relief valves comprises a valve body and a spring for pressing said valve body, the spring constants of each of said first relief valves being different from one another.

8. A tilt lock device for an outboard motor according to claim 4, wherein each of said first relief valves comprises a valve body and a spring for pressing said valve body, the spring constants of each of said first relief valves being different from one another.

* * * * *